United States Patent [19]

Wallgren et al.

[11] Patent Number: 4,641,824

[45] Date of Patent: Feb. 10, 1987

[54] CLOTH SPREADING APPARATUS WITH CUTTER

[76] Inventors: Matti Wallgren, Kangasvuokontie 7 A 8, 57220 Savonlinna 22; Pertti Tynkkynen, Peltorinne 7, 57230 Savonlinna 23, both of Finland

[21] Appl. No.: 801,676

[22] Filed: Nov. 25, 1985

Related U.S. Application Data

[63] Continuation-in-part of Ser. No. 659,242, Oct. 10, 1984, abandoned.

[30] Foreign Application Priority Data

Oct. 18, 1983 [FI] Finland ..... 833790
Sep. 28, 1984 [FI] Finland ..... 843817

[51] Int. Cl.[4] ..... B65H 29/46
[52] U.S. Cl. ..... 270/31; 83/925 CC
[58] Field of Search ..... 270/30–31; 83/925 CC

[56] References Cited

U.S. PATENT DOCUMENTS

| | | | |
|---|---|---|---|
| 492,116 | 2/1893 | Smith | 270/30 |
| 1,475,802 | 11/1923 | Dorman | 270/30 |
| 1,749,214 | 3/1930 | Gadbois | 270/31 X |
| 3,524,637 | 8/1970 | Stein | 270/31 |
| 4,322,993 | 4/1982 | Stumpf | 83/925 CC |
| 4,380,330 | 4/1983 | Smith et al. | 270/30 |
| 4,392,646 | 7/1983 | Smith et al. | 270/31 |
| 4,462,584 | 7/1984 | Smith et al. | 270/31 |

FOREIGN PATENT DOCUMENTS

| | | | |
|---|---|---|---|
| 111755 | 8/1964 | Czechoslovakia | 270/31 |
| 2552998 | 5/1977 | Fed. Rep. of Germany | 270/31 |
| 1191296 | 5/1970 | United Kingdom | 270/31 |
| 1236382 | 6/1971 | United Kingdom | 270/31 |
| 546549 | 3/1977 | U.S.S.R. | 270/31 |

*Primary Examiner*—E. H. Eickholt
*Attorney, Agent, or Firm*—Joan H. Pauly

[57] ABSTRACT

Endless conveyors (2,3) on opposite sides of a table (1) convey cloth (14) along table (1). Each longitudinal edge of cloth (14) is engaged by a plurality of devices carried by the corresponding conveyor (2,3). These devices may be catches (9) or, preferably, pins (30). Rollers (37) with brushes (38) on their outer surfaces are positioned to press cloth (14) onto pins (30). Rollers (37) are on the infeed side of a cutter (17) to ensure continued automatic feeding of cloth (14) following cutting of cloth (14). Release bars (32) are lowered to push cloth (14) off pins (30) to allow a severed length of cloth to drop onto table (1).

20 Claims, 5 Drawing Figures

CLOTH SPREADING APPARATUS WITH CUTTER

This application is a continuation-in-part of application Ser. No. 659,242, filed Oct. 10, 1984 and now abandoned.

DESCRIPTION

1. Technical Field

The present invention relates to cloth spreading apparatus comprising a spreader table, an endless conveyor on each side thereof, cutting means, and means for automatically releasing a severed length of cloth onto the table and engaging the adjacent portion of a roll of cloth to spread another length over the table.

2. Background Art

The known equipment of this type generally requires a reciprocating carriage for carrying a roll of cloth along. Such machines are heavy, and the weight of the cloth is added to the machine weight, so acceleration and deceleration distances are long. If a cloth is to be spread on a table with either the reverse or right side up, the machine must make an empty return run. If it is acceptable to spread a cloth alternately with the right side and reverse side up, there is no empty return run, but this method is sparsely used as it complicates further processing of cloth. Also available are devices provided with a reciprocating catch which grips a cloth or cloths by the end and pulls them onto a table. These devices are only suitable for spreading inextensible cloths or fabrics and also involve an unloaded return run.

U.S. Pat. No. 492,116, granted Feb. 21, 1893, to R. T. Smith, discloses a cloth folding machine having a reciprocating frame and clamping devices for gripping the folded ends of the cloth. U.S. Pat. Nos. 1,475,802, granted Nov. 27, 1923, to M. Dorman, and 4,380,330, granted Apr. 19, 1983, to H. L. Smith et al., each disclose a cloth spreader and cutter having a reciprocating carriage. In the Dorman machine, jaws mounted on the carriage grip the cloth. In the Smith et al. machine, rollers mounted on the carriage grip the cloth. U.S. Pat. No. 4,462,584, granted July 31, 1984, to H. L. Smith et al. discloses a portable clamp for a reciprocating cloth spreader. Czechoslovakian patent document No. 111,755 discloses a hydraulic device for operating a clamping mechanism for clamping the folded edges of a cloth in a cloth folding machine.

British Patent Specification No. 1,236,382 of inventor B. Sheard, published June 23, 1971, and West German Patent Specification of P. Schilling, dated May 5, 1977, each disclose a machine for spreading and stacking lengths of cloth that have already been cut by separate apparatus, which machine includes a laterally spaced pair of endless belts for moving the lengths of cloth and means for gripping the cloth. In the British patent, each longitudinal edge of the cloth is gripped between the corresponding endless belt and another endless belt oriented at right angles to and positioned below the first belt. In the German patent, the leading edge of the cloth is gripped by clips mounted on a lateral member extending between and carried by the belts. U.S.S.R. patent document No. 546,549, in the name of Orlovo, dated Mar. 23, 1977, discloses apparatus for spreading cloth on a cutting table, which apparatus includes an endless chain transporter and a clamping plate that is engagable with the transporter.

U.S. Pat. No. 1,749,214, granted Mar. 4, 1930, to J. E. Gadbois, discloses a machine for spreading, stacking, and cutting lengths of cloth. The machine includes a pair of laterally spaced endless belts for feeding the cloth from a roll into position over a cutting table, and a cutter at the infeed end of the table. One belt carries a number of clips for gripping the corresponding longitudinal edge of the cloth. A cam device opens the clips at the infeed end of the table to allow them to engage the cloth. When the end of the cloth reaches the outfeed end of the table, a release bar is lowered to open all of the clips simultaneously to release the cloth. The machine also includes a laterally extending clamp bar 24 having a plurality of pins which pierce the cloth. The cloth is engaged onto and disengaged from the pins manually.

British Patent Specification No. 1,191,296 of inventor U. Geipel, published May 13, 1970, discloses a machine which spreads and folds a continuous piece of cloth to form a layered stack. The machine includes two endless chains for conveying the cloth in one direction. The chains carry clips which engage the longitudinal edges of the cloth. A nip roller carrier reciprocates longitudinally and carries a clip opening bar that opens the clips at each end of the run to release the cloth. The cloth is guided by engagement between the rollers of the roller carrier down onto the laying surface. Geipel states that it is also possible to use chain links fitted with pins instead of clips. The manner in which the pins would engage the fabric is only described as being in accordance with another patent specification or in accordance with a "well-known" procedure in which the fabric becomes engaged by vertically upstanding pins.

The above patent documents and the prior art that is discussed and/or cited therein should be studied for the purpose of putting the present invention into proper perspective relative to the prior art.

DISCLOSURE OF THE INVENTION

The subject of the invention is apparatus for spreading, cutting, and stacking cloth. According to an aspect of the invention, the apparatus comprises a table and an endless belt-type conveyor positioned above the table on each side thereof. Each conveyor has a lower run arranged to always proceed in the same longitudinal direction from an infeed end of the table to an outfeed end thereof. Cutting means is provided for severing the cloth along a laterally extending line adjacent to the infeed end of the table. Each of the conveyors carries a plurality of longitudinally spaced cloth engaging devices for engaging the corresponding longitudinal edge of the cloth. Attaching means automatically attaches the cloth to the engaging devices to cause the cloth to be conveyed along the table by the lower run. The attaching means is positioned before the cutting means along said longitudinal direction to ensure continued automatic conveying of the cloth along said direction following severing of the cloth. Release means automatically releases a length of cloth from the engaging devices following severing of the cloth to allow such length of cloth to drop onto the table.

Preferably, each of the engaging devices is a pin mounted on the corresponding conveyor laterally inwardly thereof, and positioned to extend generally downwardly from the lower run. Each pin has a shaft with a pointed outer end for piercing the cloth and an enlarged diameter portion adjacent to the pointed end. The attaching means presses the cloth onto each pin past the enlarged diameter portion. The preferred embodiment of the attaching means comprises a roller corresponding to each conveyor. Each roller has a use position adjacent to the corresponding lower run and in the path of the pins. Each roller includes an outer surface portion easily penetrable by the pins but providing sufficient support for the cloth to press the cloth onto the pins. The outer surface portion preferably comprises a brush. The preferred embodiments of the engaging devices and the attaching means have a number of advantages, including simplicity of construction and reliability in operation.

The release means preferably comprises a longitudinally extending bar corresponding to each conveyor, and lowering means for lowering each bar to push the cloth off the pins. The preferred embodiment of the bar has a longitudinally extending brush projecting laterally outwardly therefrom and positioned to engage portions of the cloth laterally outwardly of and between the pins when the bar is lowered. The projecting brush arrangement provides quick and reliable disengagement of the cloth from the pins and helps to prevent tearing or stretching of the cloth around the pins by exerting a downward force on the cloth laterally outwardly of and between the pins as well as laterally inwardly of the pins. The lowering means preferably comprises a plurality of linear fluid motors spaced longitudinally along each bar for supporting the bar and raising and lowering the bar. The provision of the linear fluid motors insures that each bar is adequately supported along its entire length and helps to ensure the uniformity of the lowering pressure on the cloth along the length of the bar.

A preferred feature of the invention is a push plate corresponding to each conveyor in combination with means for lowering the push plates. The plates are lowered to disengage the cloth from any pins in the vicinity of the cutting means prior to severing the cloth. This allows the cutting means to clear the pins during a cutting operation regardless of the pins' longitudinal positions. Preferably, each of the rollers has a retracted position below its use position to prevent the rollers from interfering with the operation of the push plates and the cutting means. Also preferably, a support surface extends between the rollers to prevent sagging of the cloth between the rollers.

The apparatus is preferably provided with means for adjusting the height of the conveyors to accommodate changes in the height of a stack of cloth on the table. Such height adjusting means may be provided in a variety of forms, such as a plurality of jack screws.

In order to increase the versatility of the apparatus and enable it to handle cloth of varying widths, width adjusting means is preferably provided for adjusting the lateral distance between the conveyors. In the preferred embodiment, the adjusting means comprises a plurality of longitudinally spaced, laterally directed adjustment screws that engage one of the conveyors, and a longitudinally extending worm gear for rotating the screws.

The apparatus of the invention provides an efficient and effective means for spreading, cutting, and stacking cloth. The apparatus is relatively simple in construction and operation and, thus, is relatively inexpensive to manufacture and maintain. The cost of operating the apparatus is kept to a minimum since there is little, if any, need for operator intervention during operation of the apparatus and since no operation time is wasted in empty return runs. Following severing of a length of cloth, the apparatus automatically continues to feed the cloth onto the table. The apparatus of the invention operates efficiently while avoiding the problems discussed above in relation to known apparatus. Such problems include the need to carry the weight of a roll of cloth, the need to provide a machine that is heavy and powerful enough to carry such weight, and the inability to lay each length of cloth right side up without an empty return run between the laying of each length of cloth. The apparatus of the invention is also very versatile and can be used for spreading a wide variety of types of cloth. The preferred features of height adjusting and width adjusting means further increase the versatility of the apparatus. In addition, the conveying of the cloth by the lower runs of the conveyors makes it possible to minimize the length of the apparatus since the cloth can drop down onto the table from the full length of the lower runs.

These and other advantages and features will become apparent from the detailed description of the best modes for carrying out the invention that follows.

BRIEF DESCRIPTION OF THE DRAWINGS

In the drawings, like element designations refer to like parts throughout, and.

BEST MODES FOR CARRYING OUT THE INVENTION

Figure 2:
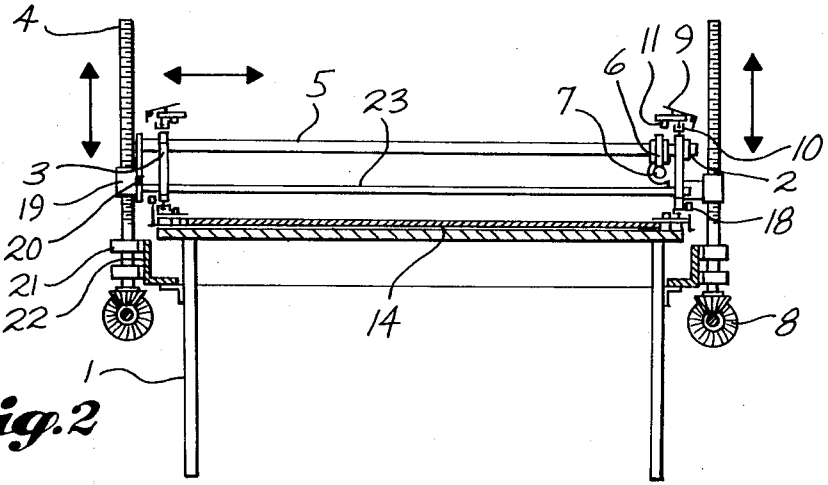
FIG. 2 is a sectional view taken along the line 2—2 in FIG. 1.
Figure 1:
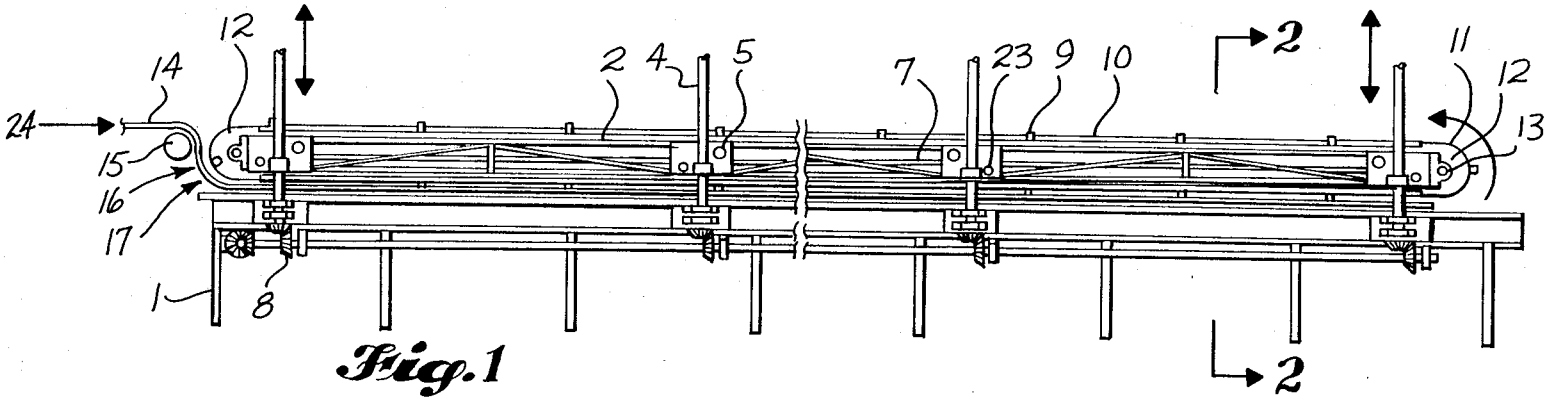
FIG. 1 is an elevational view of a first embodiment of the apparatus of the invention.

FIGS. 1 and 2 illustrate the overall configuration of the preferred embodiments of the apparatus of the invention. The machine frame comprises a spreader table 1 to which are fastened jack screws 4 by means of bearings 21. A fixed conveyor 2 and a movable conveyor 3 are mounted above the table 1 on opposite sides thereof. The jack screw nuts 19 lift and lower simultaneously both the fixed conveyor 2 and the movable conveyor 3 to adjust the height of the conveyors 2,3 to accommodate changes in the height of a stack of cloth on the table 1. The movable conveyor 3 can be laterally displaced to adjust to different widths of cloth of means of lateral screws 5, driven by a worm gear arrangement including spiral wheels 6 and helixes 7. Each conveyor 2,3 includes an endless belt or chain 11 driven by sprockets 12. The chain 11 is steered by means of a slide rail 10.

Cloth 14 is supplied from a roll rack 24 via a set of feed rollers 15. Each conveyor 2,3 carries a plurality of longitudinally spaced cloth engaging devices for engaging the corresponding longitudinal edge of the cloth 14. In the embodiment shown in FIGS. 1 and 2, catches 9 are mounted on each chain 11 with one meter spacings. Catches 9 grip the edges of the cloth at 16. The chains 11 travel at the same speed as the set of feed rollers 15, and the catches 9 pull the cloth 14 onto the table 1. When a desired length of cloth 14 has been pulled, the conveyors 2,3 stop, the cloth is cut, and a release bar 18 opens the catches 9 to allow the severed length of cloth 14 to drop down onto the table 1.

The conveyors 2,3 are always driven in the same direction. Each conveyor 2,3 has a lower run 11L arranged to always proceed in the same longitudinal direction from the infeed end of the table 1 to the outfeed end thereof. The conveyors 2,3 are arranged so that catches 9 arrive at spot 16 and grip the cloth 14. The cloth 14 is cut off at 17, and the severed end of the cloth drops down onto the table 1.

After this, a fresh layer can be conveyed into position above the table 1. The more layers of cloth that are piled up on the table, the further up the jack screws 4 lift the conveyors 2,3 by means of bevel drive 8. When the width of a cloth to be spread changes, the movable conveyor 3 is displaced laterally by means of spiral drives 6 and 7 as well as lateral screws 5.

The catch clamping means (not shown) at the clamping point 16 of catches 9 comprises guides in the travel path of the catches 9. These guides can be moved, such as by means of pneumatic cylinder devices, out of the travel path of catches 9 for preventing clamping of the catches 9 whenever a defective specimen, cut off at 17, is to be moved to the rear end of the spreader table 1 or driven out of the table 1.

In order to ensure that cloth 14 is appropriately loose at catching point 16 to be gripped by catches 9, the peripheral speed of feed rollers 15 is the same or slightly higher than the speed of chains 11.

Figure 3:
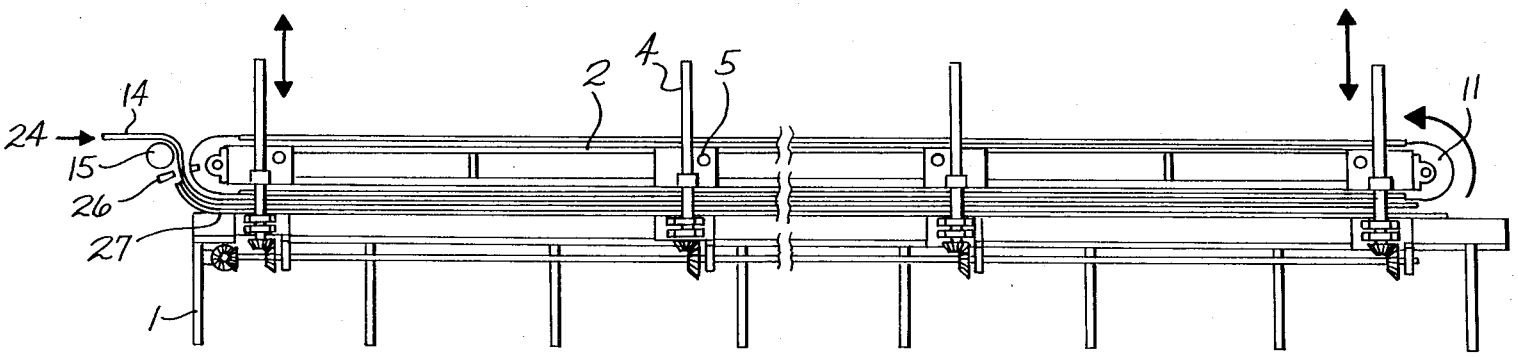
FIG. 3 is an elevational view of a second embodiment.

FIG. 3 illustrates a further development of an earlier embodiment of the means for gripping the edges of a cloth. Like the embodiment of FIGS. 1 and 2, the embodiment of FIG. 3 has a machine frame comprising a spreader table 1 fitted with jacking means 4. Supported on jacking means 4 are endless conveyors 11 on opposite sides of the apparatus. The jacking means 4 lifts and lowers simultaneously both the fixed conveyor 2 and the laterally displaceable conveyor 3. The laterally displaceable conveyor 3 is adjusted according to the width of a cloth by means of shafts 5.

Mounted on the sides supporting said conveyors 2,3 are liftable and lowerable sliding surfaces 27 below the lower runs of conveyor belts 11. When sliding surfaces 27 are in their uplifted position immediately adjacent to the lower surface of conveyor belts 11, either slightly spaced therefrom or in sliding contact therewith, the edges of cloth 14 supplied from a roll stand 24 via a feeding means 15 find their way between conveyor runs 11 and sliding surfaces 27. While it travels, each conveyor belt 11 pulls the cloth 14 forward and, as soon as a desired spreading length is reached, conveyor belts 11 stop, a cutter device 26 cuts off the cloth 14, and sliding surfaces 27 are opened, i.e. move downwards allowing the cloth 14 to fall onto the table. Thereafter, said feeding means 15 delivers the cloth 14 to conveyor belt 11 again, sliding surfaces 27 are closed, and a fresh operation cycle begins. As the pile of cloth deposited on the table 1 grows higher, the jacking means 4 lifts the conveyors 2,3 higher.

Instead of said sliding surfaces 27, the press means providing the gripping between cloth edges and conveyor belts can also comprise endless belts whose upper runs at least are liftable and lowerable for effecting and loosening a grip of the cloth edges.

Figure 4:
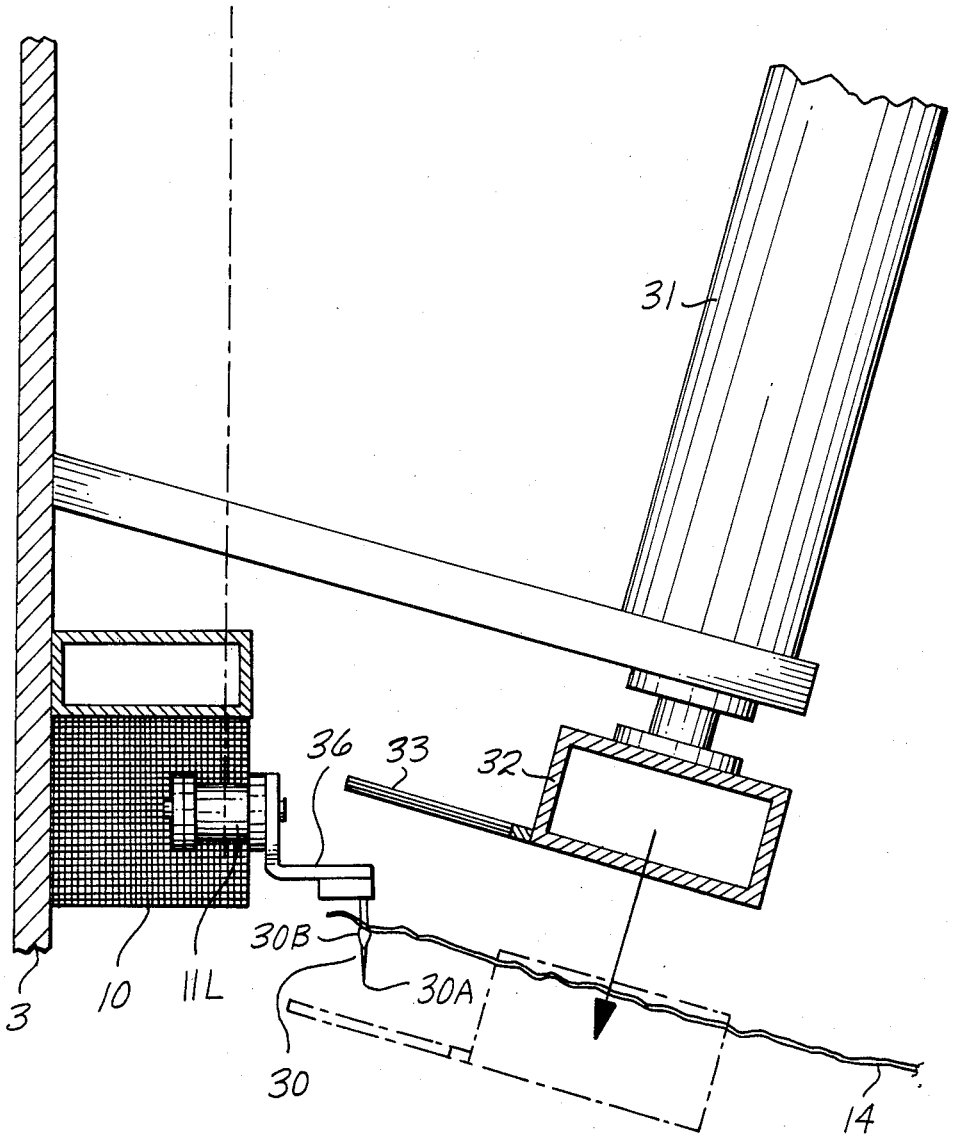
FIG. 4 is a vertical sectional view of one of the conveyors and the engaging and release means associated therewith in a third, most preferred, embodiment.
Figure 5:
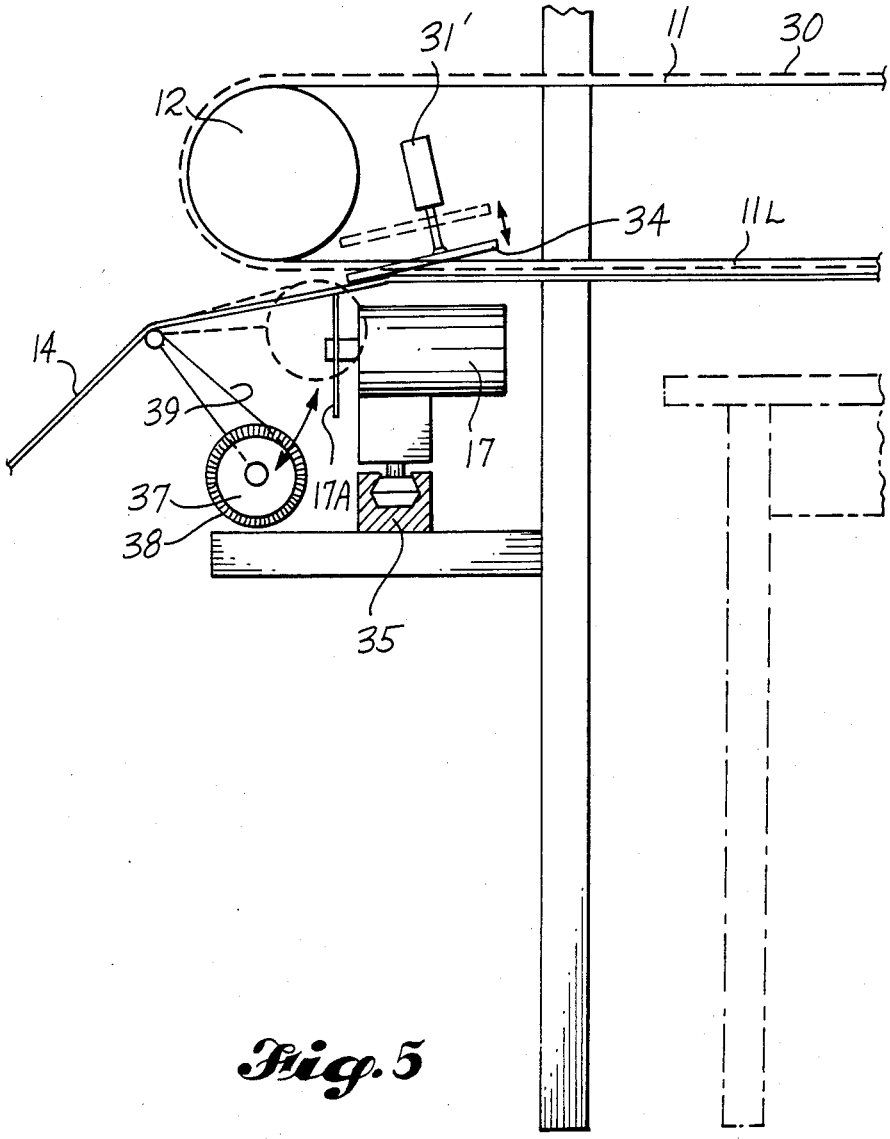
FIG. 5. is a side view of one end of a conveyor and the associated attaching and cutting means in said third embodiment, with parts shown in section.

FIGS. 4 and 5 show the most preferred embodiment of the cloth engaging and release means and the cutting means. FIG. 4 shows in enlarged scale the cross section of a side area of the apparatus illustrating the cloth edge engaging and releasing devices. Slide rail 10, closely connected to the conveyor 3, is provided with a lateral groove along which the conveyor chain or belt 11 moves. Cloth engaging devices in the form of pins 30 are fastened to the chain 11 at suitable intervals.

The pins 30 are mounted on pin brackets 36 that are attached to the conveyor chain 11 and extend laterally inwardly thereof. The brackets 36 position the pins 30 laterally inwardly of the chain 11, and the pins 30 are positioned with respect to the brackets 36 so that they extend generally downwardly from the lower run of the conveyor chain 11. Each pin 30 has a shaft with a pointed outer end 30A and an enlarged diameter portion 30B adjacent to the pointed end 30A. The apparatus is provided with attaching means for pressing the cloth 14 onto each pin 30 past the enlarged diameter portion 30B. The threads of the cloth then close around the pin shaft, and the enlarged diameter portion 30B prevents the cloth 14 from slipping off the pin 30.

The cloth 14 is released from the pins 30 by means of two longitudinally extending pressing bars 32, one corresponding to each conveyor 2,3. Each pressing bar 32 is mounted adjacent to the corresponding lower conveyor run 11L and adjacent to the pins 30. A plurality of pneumatic cylinders 31 raises and lowers each bar 32. These cylinders 31 are positioned at suitable intervals so that each bar 32 is sufficiently supported along its entire length. Each bar 32 has a longitudinally extending brush 33 attached thereto. The brush 33 projects laterally outwardly from the bar 32 and is positioned to engage portions of the cloth 14 that are laterally outward of the pins 30 or between the pins 30, as well as portions laterally inward of the pins 30. When bar 32 is lowered in the direction of the arrow in FIG. 4 into the position indicated by the dotted lines, the brush 33 pushes the longitudinal edge of the cloth 14 off the pins 30 to release the cloth 14 and allow it to drop onto the table 1.

FIG. 5 is a side view of the infeed end of the table 1 and the associated cutting means and attaching means for automatically attaching the cloth 14 to the pins 30. Below the lower run 11L of each conveyor 2,3 is a roller 37 which has a brush or felt outer surface portion 38 so that each pin 30 can easily penetrate into its circumference facing the cloth 14 while the roller 37 simultaneously presses the cloth 14 onto the pin 30. Each roller 37 has a use position (illustrated in broken lines in FIG. 5) in which it is positioned adjacent to the corresponding lower run 11L and in the path of the pins 30. Each roller 37 also has a retracted position (shown in solid lines in FIG. 5) below its use position to prevent the roller 37 from interfering with the operation of push plates 34, described below, and the cutting means. The rollers 37 are moved between these positions by suitable known means (not shown). An important feature of the invention is the positioning of the rollers 37 before the cutting means along the direction of feed of the cloth 14 to ensure continued automatic conveying of the cloth 14 in such direction following severing of the cloth 14 by the cutting means. Following cutting of the cloth 14, in infeed severed end of the cloth 14 falls down onto the rollers 37 so that such severed end can be pushed onto the pins 30 by the rollers 37.

The cutting means includes a cutting device 17 which has a rotating cutter blade 17A. The cutting device 17 moves laterally across the table 1 along rail 35 to cut the cloth 14 along a laterally extending line adjacent to the infeed end of the table 1. A push plate 34 is provided at the infeed end of each conveyor 2,3 for disengaging the cloth 14 from any pins 30 in the vicinity of the cutting blade 17A prior to the cutting operation. Each plate 34 is lowered by a pneumatic cylinder 31' to engage the cloth 14 and push it off such pins 30. This allows the portion of the cloth 14 in the vicinity of the cutting blade 17A to drop down a small amount, as illustrated in FIG. 5. This in turn allows the cutting blade 17A to be positioned below the pins 30 so that the cutting blade 17A will clear the pins 30 during a cutting operation regardless of the pins' longitudinal positions. The plates 34 are operated in much the same manner as the release bars 32, but the plates 34 have a much smaller longitudinal dimension than the bars 32.

In the operation of the apparatus, when the desired length of cloth has been conveyed over the table 1, the conveyors 2,3 are stopped, the attachment rollers 37 are swung downward into their retracted positions, and the cylinders 31' move the push plates 34 downward to detach the cloth 14 from the pins 30 in the vicinity of the cutting point. Then, the cutter 17 with rotating blade 17A is moved along rail 35 crosswise of the cloth 14 to cut the cloth 14. After this, the bars 32 are lowered to disengage the longitudinal edges of the severed length of cloth 14 from the pins 30. Then, the bars 32 and push plates 34 are lifted and the attaching rollers 37 are swung up into their use positions. The drive of conveyors 2,3 is started, and the idle rollers 37 are rotated with the conveyors 2,3 to press the cloth edges into engagement with the pins 30. Between the rollers 37, there is a support surface 39 for the cloth 14. This surface 39 extends across the infeed end of table 1 and prevents sagging of the cloth 14 between the rollers 37.

The apparatus is provided with appropriate drive means, switches, and valves for controlling the various operations. The synchronization of the operations of the cylinders 31,31' and the drive means is accomplished by a preprogrammable microprocessor which controls the operations of the valves and switches.

It should be obvious to those skilled in the art to which this invention is addressed that the invention may be used to advantage in a variety of situations and that various modifications and omissions in form and detail may be made without departing from the spirit and scope of the invention as defined in the following claims.

What is claimed is:

1. Apparatus for spreading, cutting, and stacking cloth, said apparatus comprising a table; an endless belt-type conveyor positioned above the table on each side thereof and having a lower run arranged to always proceed in the same longitudinal direction from an infeed end of the table to an outfeed end thereof; cutting means for severing the cloth along a laterally extending line adjacent to said infeed end; a plurality of longitudinally spaced cloth engaging devices carried by each such conveyor for engaging the corresponding longitudinal edge of the cloth; attaching means for automatically attaching the cloth to said engaging devices to cause the cloth to be conveyed along the table by said lower run, said attaching means being positioned before the cutting means along said longitudinal direction to ensure continued automatic conveying of the cloth along said direction following severing of the cloth; and release means for automatically releasing a length of cloth from the engaging devices following severing of the cloth to allow said length of cloth to drop onto the table.

2. Apparatus as described in claim 1, in which each of said engaging devices is a pin mounted on the corresponding conveyor laterally inwardly thereof and positioned to extend generally downwardly from said lower run, said pin having a shaft with a pointed outer end for piercing the cloth and an enlarged diameter portion adjacent to said pointed end; and in which said attaching means presses the cloth onto each pin past said enlarged diameter portion.

3. Apparatus as described in claim 2, in which the attaching means comprises a roller corresponding to each conveyor; each such roller having a use position adjacent to the corresponding lower run and in the path of said pins, and including an outer surface portion easily penetrable by the pins but providing sufficient support for the cloth to press the cloth onto the pins.

4. Apparatus as described in claim 3, in which said outer surface portion comprises a brush.

5. Apparatus as described in claim 2, in which the release means comprises a longitudinally extending bar corresponding to each conveyor, and lowering means for lowering each bar to push the cloth off the pins.

6. Apparatus as described in claim 5, in which each bar has a longitudinally extending brush projecting laterally outwardly therefrom and positioned to engage portions of the cloth laterally outwardly of and between the pins when the bar is lowered.

7. Apparatus as described in claim 3, in which the release means comprises a longitudinally extending bar corresponding to each conveyor, and lowering means for lowering each bar to push the cloth off the pins.

8. Apparatus is described in claim 7, in which each bar has a longitudinally extending brush projecting laterally outwardly therefrom and positioned to engage portions of the cloth laterally outwardly of and between the pins when the bar is lowered.

9. Apparatus as described in claim 4, in which the release means comprises a longitudinally extending bar corresponding to each conveyor, and lowering means for lowering each bar to push the cloth off the pins.

10. Apparatus as described in claim 9, in which each bar has a longitudinally extending brush projecting laterally outwardly therefrom and positioned to engage portions of the cloth laterally outwardly of and between the pins when the bar is lowered.

11. Apparatus as described in claim 2, further comprising a push plate corresponding to each conveyor, and means for lowering the plates to disengage the cloth from any pins in the vicinity of the cutting means prior to servering the cloth, to allow the cutting means to clear the pins during a cutting operation regardless of the pins' longitudinal positions.

12. Apparatus as described in claim 3, further comprising a push plate corresponding to each conveyor, and means for lowering the plates to disengage the cloth from any pins in the vicinity of the cutting means prior to severing the cloth, to allow the cutting means to clear the pins during a cutting operation regardless of the pins' longitudinal positions.

13. Apparatus as described in claim 12, in which each of said rollers has a retracted position below its use position to prevent the rollers from interfering with the operation of the push plates and the cutting means.

14. Apparatus as described in claim 3, in which the attaching means further comprises a support surface extending between the rollers to prevent sagging of the cloth between the rollers.

15. Apparatus as described in claim 12, in which the attaching means further comprises a support surface extending between the rollers to prevent sagging of the cloth between the rollers.

16. Apparatus as described in claim 13, in which the attaching means further comprises a support surface extending between the rollers to prevent sagging of the cloth between the rollers.

17. Apparatus as described in claim 5, in which the lowering means comprises a plurality of linear fluid motors spaced longitudinally along each bar for supporting the bar and raising and lowering the bar.

18. Apparatus as described in claim 6, in which the lowering means comprises a plurality of linear fluid motors spaced longitudinally along each bar for supporting the bar and raising and lowering the bar.

19. Apparatus as described in claim 1, further comprising a plurality of jack screws for adjusting the height of the conveyors to accommodate changes in the height of a stack of cloth on the table.

20. Apparatus as described in claim 1, further comprising width adjusting means for adjusting the lateral distance between the conveyors to different widths of cloth; said adjusting means comprising a plurality of longitudinally spaced, laterally directed adjustment screws that engage one of the conveyors, and a longitudinally extending worm gear for rotating the screws.

* * * * *